US006223680B1

(12) United States Patent
Frink et al.

(10) Patent No.: US 6,223,680 B1
(45) Date of Patent: May 1, 2001

(54) SUN BONNET FOR A WATERCRAFT

(75) Inventors: Thomas H. Frink; Sandy J. Frink, both of San Clemente, CA (US)

(73) Assignee: Waveshade, LLC., Lake Havasu City, AZ (US)

( * ) Notice: Subject to any disclaimer, the term of this patent is extended or adjusted under 35 U.S.C. 154(b) by 0 days.

(21) Appl. No.: 08/703,569

(22) Filed: Aug. 27, 1996

(51) Int. Cl.[7] ..... B63B 17/00
(52) U.S. Cl. ..... 114/361; 114/55.5
(58) Field of Search ..... 114/343, 347, 114/363, 361, 270; 135/88.01; D12/317

(56) References Cited

U.S. PATENT DOCUMENTS

| | | | | |
|---|---|---|---|---|
| D. 259,340 | | 5/1981 | Stengel | D12/156 |
| D. 307,347 | | 4/1990 | Gibson | D34/35 |
| 617,571 | * | 1/1899 | Harlow | 114/361 |
| 811,322 | * | 1/1906 | Poltock | 114/361 |
| 2,618,285 | * | 11/1952 | Heisig | 114/361 |
| 2,714,387 | * | 8/1955 | Meldrum | 114/361 |
| 2,821,204 | * | 1/1958 | Hartshorn, Sr. | 114/361 |
| 2,974,329 | * | 3/1961 | Welch | 114/361 |
| 3,572,353 | | 3/1971 | Pinkley | 135/6 |
| 3,734,110 | | 5/1973 | Burns | 135/1 A |
| 3,955,228 | | 5/1976 | Gaschenko | 9/1 B |
| 4,503,799 | * | 3/1985 | Masters | 114/347 |
| 4,582,016 | | 4/1986 | Hansen | 114/361 |
| 4,683,900 | | 8/1987 | Carmichael | 135/88 |
| 5,009,184 | | 4/1991 | Voldrich | 114/361 |
| 5,044,298 | | 9/1991 | Pepper | 114/361 |
| 5,070,807 | | 12/1991 | Lewis | 114/361 |
| 5,111,765 | * | 5/1992 | Kobayashi | 114/361 |

* cited by examiner

*Primary Examiner*—Ed Swinehart
(74) *Attorney, Agent, or Firm*—Gene Scott-Patent Law & Venture Group

(57) ABSTRACT

A shade for a personal watercraft includes a canopy and a canopy support frame. The shade is formed to provide a clearance such that a person thrown from the craft to either of its sides is not in danger of striking the canopy or its frame. The frame is easily broken down into small, easily transported components and is quickly assembled and mounted onto the craft. A breakaway strap holds the shade in position at the helm of the craft.

6 Claims, 5 Drawing Sheets

78A
78B 7
7
78A
74B
70
10
76B
80
78B
50
90
90A
60
6
72B
100
5A
5

SUN BONNET FOR A WATERCRAFT

BACKGROUND OF THE INVENTION

1. Field of the Invention

This invention relates generally to sun shading and sheltering tops for watercraft, and more particularly to a sun bonnet assembly which is easily installed and broken down when removed for compact stowage.

2. Description of Related Art

The following art defines the present state of this field:

Gaschenko et al., U.S. Pat. No. 3,955,228 describes a boat shade comprising of a cover and a frame. The frame being formed of three inverted U-shaped components, one of an inverted U-shaped component of said frame being erected vertically and fastened at its ends to the opposite sides of the boat with the possibility of being pivoted. Two other inverted U-shaped components of the frame, arranged on both sides of the component of said frame. Hinges join said sliders to the ends of the inverted U-shaped components carrying the cover.

Pepper et al., U.S. Pat. No. 5,044,298 describes a boat comprising of a deck having a forwardly located helm, a canopy including a rearwardly located permanent cover, spaced apart portions extending forwardly defining an open opening. A second cover does not extend over said opening but when in an extended position it does extend over the opening. A canopy is located above said helm and spaced so as to permit an operator to stand or sit adjacent said helm.

Lewis, U.S. Pat. No. 5,070,807 describes a generally low profile, lightweight canopy assembly for a watercraft which embodies a transom member with a top edge, generally coplanar with peripheral side wall gunwale areas, said craft also having a plurality of interiorly disposed, peripherally spaced attachment means adaptable for attaching various items, a safety grab line, as well as canopy-supporting frame members.

Burns, U.S. Pat. No. 3,734,110 describes structures such as rack, shelters and the like which are adapted to be attached to a vehicle top that are assembles with corner members which are shaped to receive and grip different lengths of pipe. These structures are also provided to the vehicle top whereby the structures are readily attached to the top of a vehicle or to the side thereof.

Hansen, U.S. Pat. No. 4,582,016 describes a frame structure for supporting a flexible material for a marine vehicle convertible roof operative to provide protection for a vehicle occupant area having a predetermined length.

Voldrich, U.S. Pat. No. 5,009,184 describes a canopy for an open boat comprising a frame, the frame consisting of a pair of reversely L-shaped fixed angled tubular supports mounted on either side of the boat said supports having substantially horizontal and substantially vertical portions.

Pinkley, U.S. Pat. No. 3,572,353 describes a convertible top for boats and the like having a deck or support structure surrounding a passenger compartments and preceded by a windshield. Removable side rails extend from the top side edge of the windshield over the passenger seating area, and then downwardly to the deck. A cross bar extends between the rear of the front generally horizontal portion of the side rails.

Carmichael, U.S. Pat. No. 4,683,900 describes a canopy for use an open-topped vehicle such as a boat, tractor, or the like having two spaced-apart, substantially parallel, side rails.

Gibson, U.S. Pat. No. D307,347 describes a design for a fork lift canopy cover.

Stengel, U.S. Pat. No. D259,340 describes a design for and open side top for jeeps.

The prior art teaches various shading devices and top for watercraft and other vehicles. However, the prior art does not teach a shading device for a personal watercraft that provides shading from the sun overhead and also is not an obstruction to a rider being thrown laterally or rearwardly from the watercraft. The present invention fulfills these needs and provides further related advantages as described in the following summary.

SUMMARY OF THE INVENTION

The present invention teaches certain benefits in construction and use which give rise to the objectives described below.

In certain sport watercraft, usually referred to as personal watercraft, a rider and also one or more passengers, sit astride the craft's beam. In sharp turns or in rough waters, one or more persons are frequently thrown from the craft. This is generally not a problem as the clearance around the craft is sufficient such that a person thrown from the craft is not apt to be injured by striking structural members of the watercraft. However, it is desirable to provide a means for shading persons on such watercraft from the sun. The present invention is a shading means for personal watercraft. A primary objective of the present invention is to provide shade from the sun and rain in a personal watercraft without hampering operation of the craft. Another objective is to provide such a shading means that maintains the typical clearance around a personal watercraft so that a person thrown from the craft is not in danger of striking the shading means. A further objective is to provide such a shading means that also is easily broken down into small components for compact storage off the watercraft or stowage on it. A still further objective is to provide such a shading means that is light in weight so that operation and performance of the watercraft are not diminished by its use. A final objective is to provide such a shading means that is structurally sound so as not to be damaged with the normal use of a personal watercraft.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
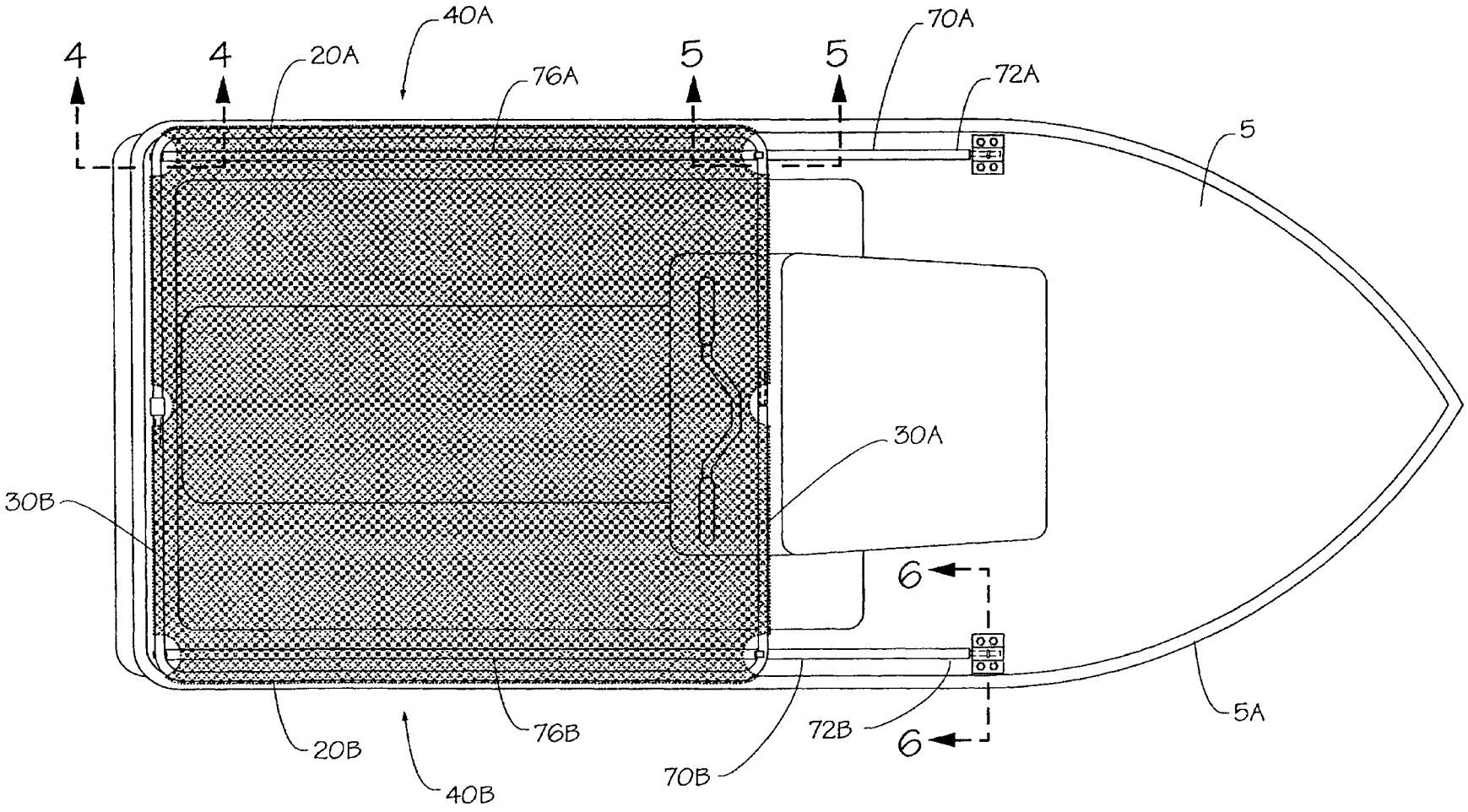
FIG. 1 is a top plan view of the preferred embodiment of the present invention.
Figures 2, 7:
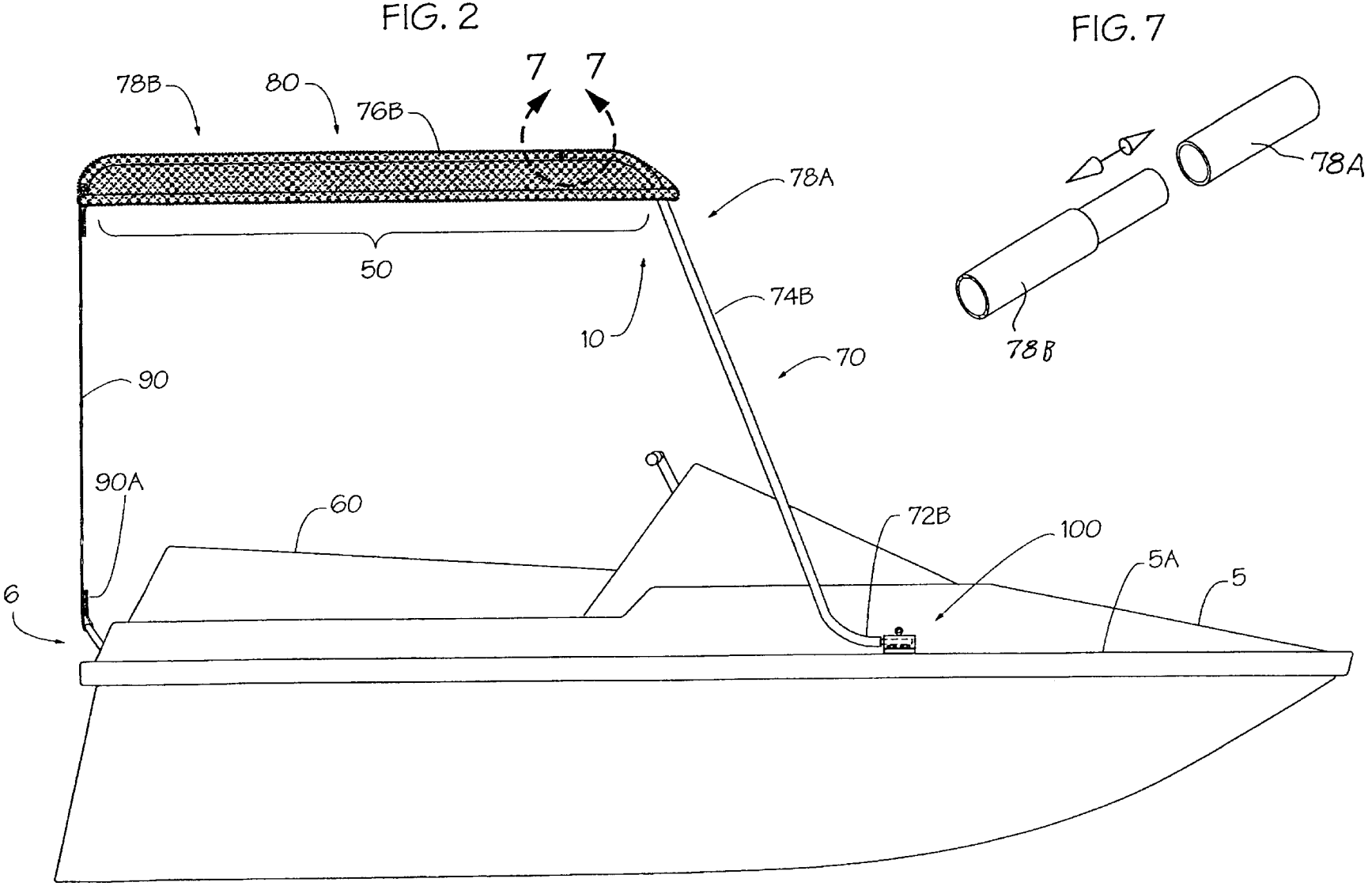
FIG. 2 is a side elevational view thereof.
FIG. 7 is a perspective view of a portion of a bonnet support means taken in accordance with line 7—7 in FIG. 2.
Figure 5:
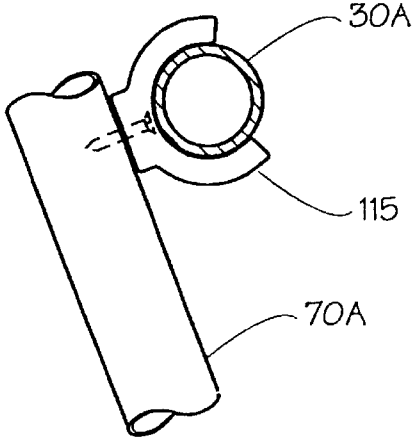
FIG. 5 is a partial side elevational view in accordance with cutting line 5—5 of FIG. 1.
Figure 10:
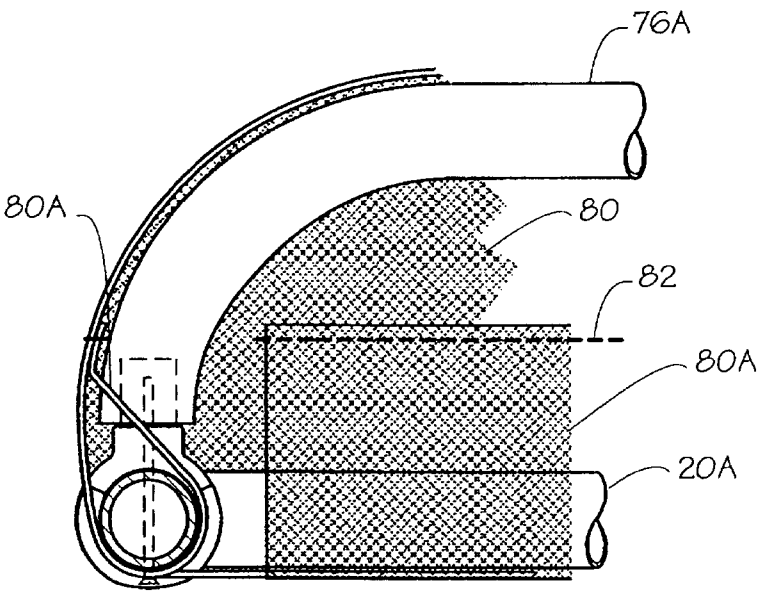
FIG. 10 is a partial side elevational view in accordance with cutting line 10—10 of FIG. 3.
Figure 4:
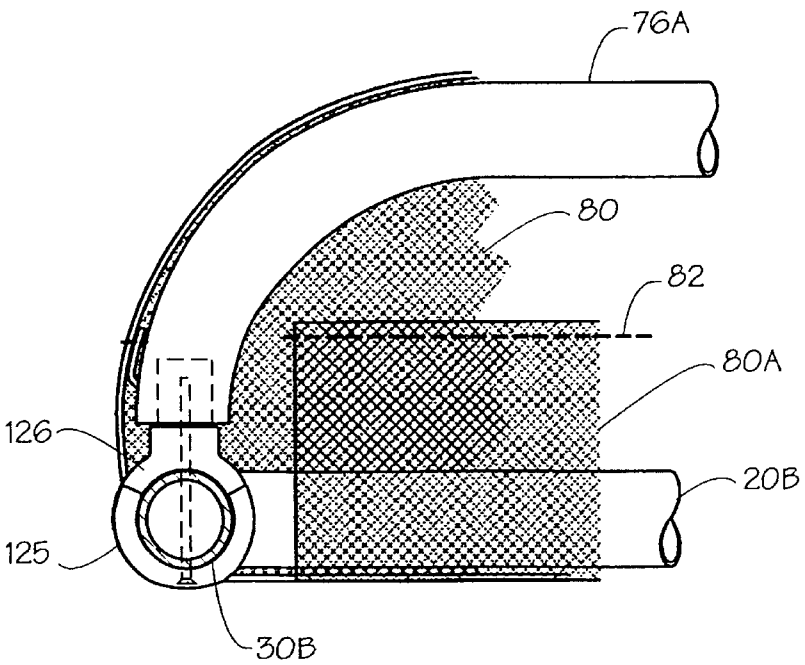
FIG. 4 is a partial side elevational view in accordance with cutting line 4—4 of FIG. 1.
Figure 9:
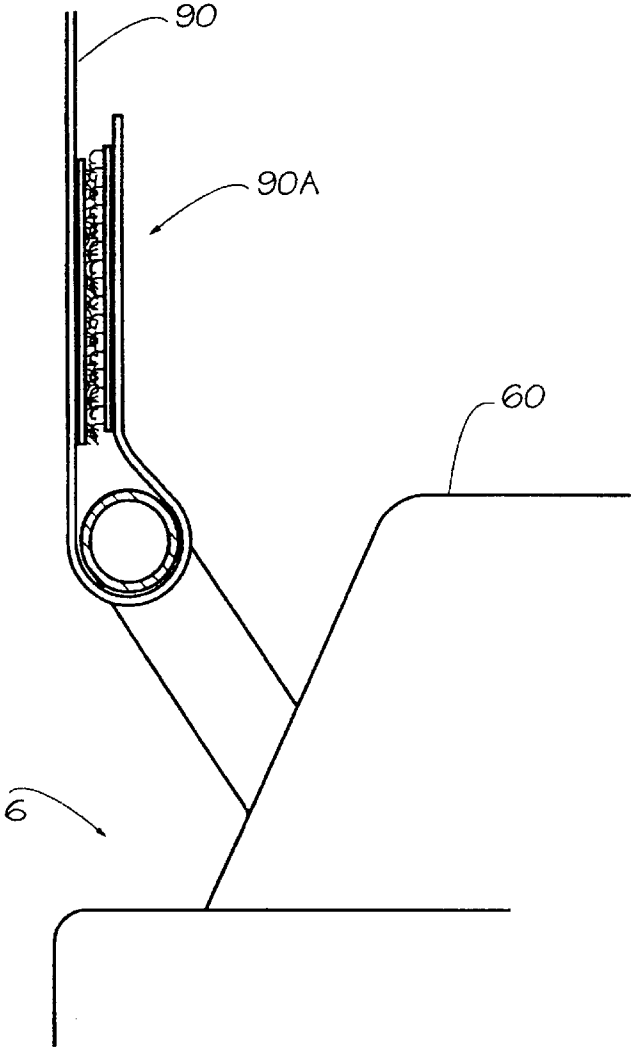
FIG. 9 is a partial side elevational view in accordance with cutting line 9—9 of FIG. 3.
Figure 8:
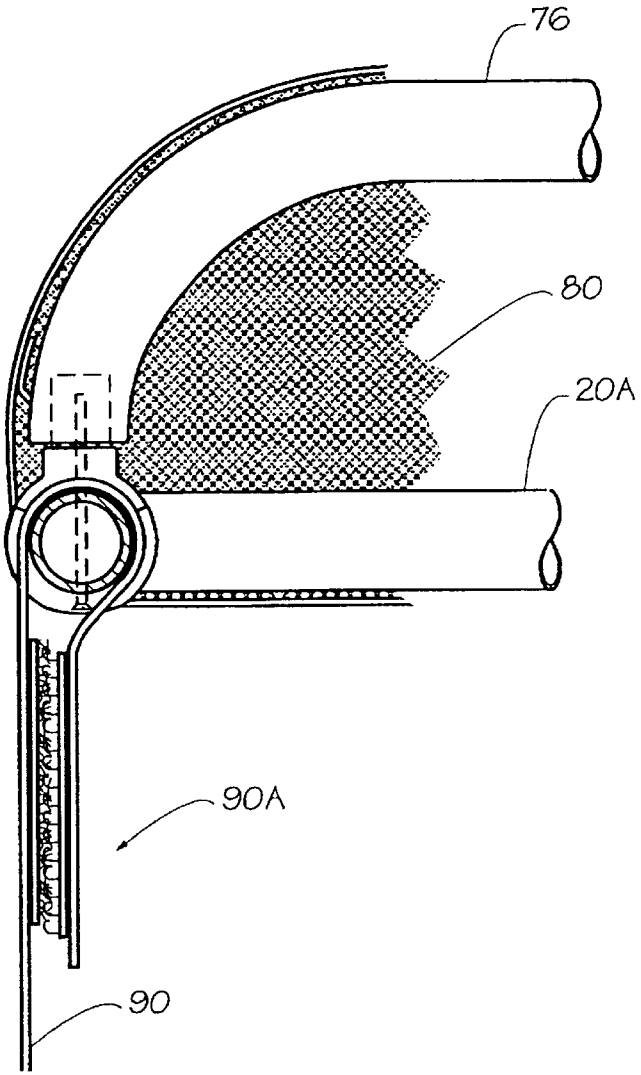
FIG. 8 is a partial side elevational view in accordance with cutting line 8—8 of FIG. 3.

The above described drawing figures illustrate the invention, a shading device for a watercraft 5. The shading device may be considered as a separate inventive entity from the watercraft or may be considered as an integral part thereof. In either case, the shading device includes a rigid superstructure 10, as best seen in FIG. 2, preferably constructed of tubular members, preferably of aluminum or steel. It includes a rectangular frame portion 20 made-up of a pair of opposing longitudinally oriented elongate side members 20A and 20B, interconnected with a pair of opposing laterally oriented elongate end members 30A and 30B, the rectangular frame portion 20 is preferably a closed figure preferably comprising a pair of horizontally oriented, removably and mutually engaged, C-shaped members 40A and 40B which are joined amidships, and define an open central area 50 of the frame portion 20, and it is supported in a horizontal orientation above a means for seating 60 of the watercraft 5, by a strut means 70. The strut means 70 is removably engaged with both the frame portion 20 and with the watercraft 5 so that the superstructure 10 is removably interconnected integrally with the watercraft 5. The strut means 70 is preferably comprised of two laterally disposed strut members 70A and 70B, and its interconnection with the watercraft 5 is positioned forward of seating means 60 so that a person (not shown) falling sideways out of the watercraft 5 is not likely to strike the strut members 70A and 70B. This is a critically important feature of the construction of the superstructure 10. Strut members 70A and 70B are interconnected with frame portion 20 at lateral frame member 30B as shown in FIG. 4. In the preferred embodiment, portion 76A of strut members 70A and 70B terminates at a first attachment means 125 and 126, joined by a screw, as shown in FIG. 4, the attachment means 125 and 126 preferably encircles frame member 30B so as to ensure a strong but removable joint. It is assumed in this embodiment that portion 126 of the attachment means is permanently fixed to strut 76A. Likewise, as shown in FIG. 5, the frame member 30A is attached to struts 70A and 70B by second attachment means 115, preferably a pair of collars screwed to struts 70A and 70BA respectively. Preferably, superstructure cover 80 is made of a flexible fabric material such as canvas or other fabric and extends over the rectangular frame portion 20 and the strut means 70 so as to be laid-out in a generally horizontal orientation for providing shade over the seating means 60. A means is provided for removably attaching the cover 80 to the rectangular frame portion 20 so that the cover 80 is tightly stretched over it. Such an attachment means is preferably a sleeve hem 80A sewn into the cover 80 along stitch line 82, as best seen in FIGS. 4 and 10.

Preferably, at least one interconnecting strap 90 joins the shading device with the stern 6 of the watercraft 5. The strap 90 provides a means for quickly releasing 90A the strap 90 from the stern 6 when a lateral force is exerted upon it such as a persons body might, as it falls out of the craft 5 rearwardly. Such a quick release means mechanism is preferably a hook and loop type fastener solution such as Velcro®. The placement of strap 90, too, is critical to the successful operation of the shading device since personnel frequently fall out of certain types of watercraft, such as high speed personal watercraft. When a rider strikes the strap 90, it releases from the stern 6 of the craft 5 so that the rider and the shading device are not injured or damaged respectively.

The strut members 70A and 70B are preferably positioned generally in mutual parallel juxtaposition, one of the strut members 70A running generally along the port side of the watercraft 5, the other of the strut members 70B running generally along the starboard side of the watercraft 5, each of the strut members providing a generally horizontally oriented first portion 72A and 72B, laid adjacent to the deck 5A of the watercraft 5 and engaged therewith for supporting the shading device. This first portion 72A,B is positioned preferably forward of the operator or passenger on the watercraft 5 so that if either the operator or passenger are thrown sideways from the craft, they are unlikely to strike the first portion 72A,B of either of the strut members 70A,B. A generally horizontally oriented third portion 76A and 76B of the strut members 70A,B is positioned above the deck 5A and preferably extends above a substantial portion of the means for seating 60 of the watercraft 5. This portion is generally over the top of the heads of operator or passenger so that it is not an obstruction to personnel movement either into or out of the craft 5. A second portion 74A and 74B interconnects the first 72A,B and third 76A,B portions of each of the strut members 70A,B preferably forming a modified (reverse) S-shaped pattern, so that it acts to support and hold the third portion 76A,B in position at all times and along with it, the rectangular frame 20 of the superstructure 10. Preferably, each of the strut members 70A,B is comprised of two or more strut sections 78A and 78B which are interconnected to assemble each finished strut member 70A, B.

Figure 6:
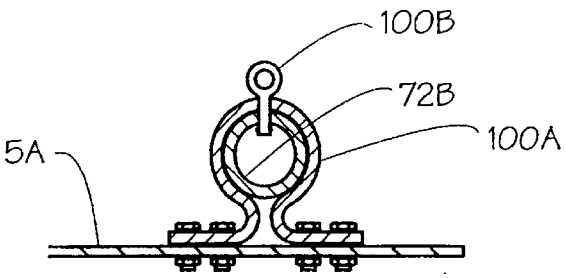
FIG. 6 is a partial side elevational view in accordance with cutting line 6—6 of FIG. 1.
Figure 3:
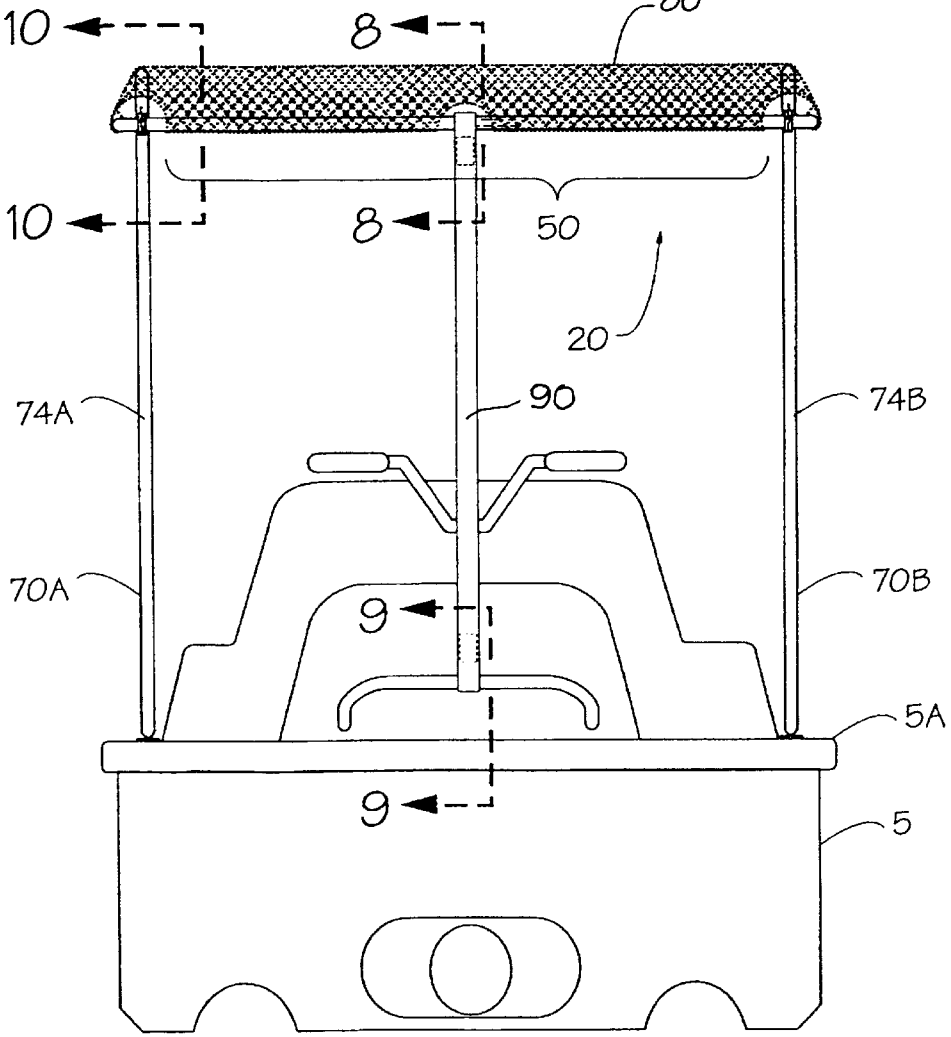
FIG. 3 is a rear view thereof.

A means for removably attaching 100 the superstructure 10 to the watercraft 5 is provided. This attaching means 100, as seen in FIG. 6, is preferably a pair of tubular stanchions 100A attached to the forward portion of the watercraft's deck 5A. The first portion of the struts 72A,B are engaged within these stanchions 100A so as to be rigidly and securely held in place. A pin 100B or other connector is preferably used to hold the strut means 70 in place within the stanchions 100A.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination shading device and shading device support structure for a watercraft, the combination comprising:

a rigid superstructure providing a pair of struts positioned generally in mutual parallel juxtaposition, one of the struts aligned with a port side of the watercraft, the other of the struts aligned with a starboard side of the watercraft, each of the struts providing a generally horizontally oriented first portion engagable with the watercraft in a position forward of a cargo carrying area of the watercraft for supporting the shading device, and a generally horizontally oriented third portion extending along a substantial portion of the cargo carrying area of the watercraft, and a second portion interconnecting the first and third portions of each of the struts; the superstructure further including a rectangular frame portion made-up of a pair of opposing longitudinally oriented elongate side members, interconnected with a pair of opposing laterally oriented elongate end members, the rectangular frame portion removably engaged with the pair of struts, the struts supporting the frame portion in a generally horizontal orientation;

a means for removably attaching the superstructure to the watercraft;

a superstructure cover of a flexible fabric material, the cover extending over the rectangular frame portion and the third portions of the struts so as to be laid-out in a generally horizontal orientation;

a means for removably attaching the cover to the rectangular frame portion so that the cover is tightly stretched thereon.

2. The device of claim 1 wherein the second portions of the struts are positioned forward of the cargo carrying area of the watercraft.

3. The device of claim 2 wherein the first, second and third portions of each of the struts forms a modified S-shape.

4. The device of claim 1 wherein the struts are each comprised of two or more separable strut members.

5. The device of claim 1 wherein at least one interconnecting strap joins the device with the stern of the watercraft.

6. The device of claim 5 further including a means for quickly releasing the strap from the stern when a lateral force is exerted upon the strap.

* * * * *